US006986712B1

(12) United States Patent
Ogawa

(10) Patent No.: US 6,986,712 B1
(45) Date of Patent: Jan. 17, 2006

(54) SCORE MANAGEMENT SYSTEM, SCORE MANAGEMENT SERVER, AND DATA RECORDING MEDIUM

(76) Inventor: Hideharu Ogawa, 6-18, Osaki 2-chome, Shinagawa-ku, Tokyo 141-0032 (JP)

( * ) Notice: Subject to any disclaimer, the term of this patent is extended or adjusted under 35 U.S.C. 154(b) by 0 days.

(21) Appl. No.: 09/762,772

(22) PCT Filed: Jun. 9, 2000

(86) PCT No.: PCT/JP00/03747

§ 371 (c)(1),
(2), (4) Date: Feb. 13, 2001

(87) PCT Pub. No.: WO00/76599

PCT Pub. Date: Dec. 21, 2000

(30) Foreign Application Priority Data

Jun. 14, 1999 (JP) ..... 11-166354

(51) Int. Cl.
*A63F 13/00* (2006.01)

(52) U.S. Cl. ..... 463/42; 700/91

(58) Field of Classification Search ..... 463/30, 463/31, 35, 37, 39, 40, 41, 42, 43, 44; 700/91, 700/92; 473/131; 340/323 R
See application file for complete search history.

(56) References Cited

U.S. PATENT DOCUMENTS

| | | | | |
|---|---|---|---|---|
| 3,959,640 A | | 5/1976 | Syria | |
| 4,319,131 A | | 3/1982 | McGeary et al. | |
| 4,910,677 A | | 3/1990 | Remedio et al. | |
| 5,027,102 A | | 6/1991 | Sweeny | |
| 5,283,733 A | * | 2/1994 | Colley | 340/323 R |
| 5,949,679 A | * | 9/1999 | Born et al. | 700/91 |
| 6,062,991 A | * | 5/2000 | Moriarty et al. | 473/407 |
| 6,745,043 B1 | * | 6/2004 | Lester et al. | 455/512 |
| 6,839,435 B1 | * | 1/2005 | Iijima et al. | 380/251 |

FOREIGN PATENT DOCUMENTS

| | | |
|---|---|---|
| EP | 0674924 | 10/1995 |
| FR | 2673116 | 8/1992 |
| FR | 2679676 | 1/1993 |
| JP | 03-051067 | 3/1991 |
| WO | WO90/03204 | 4/1990 |
| WO | WO94/05380 | 3/1994 |

* cited by examiner

*Primary Examiner*—Kim Nguyen
(74) *Attorney, Agent, or Firm*—Mitchell P. Brook; Luce, Forward, Hamilton & Scripps LLP

(57) ABSTRACT

A score management system comprises mobile terminals and a score management server which are connected to each other via a wireless communication network. The score management server stores score data, receives a request for displaying score status from the mobile terminal, transmits data representing the score status based on the stored score data to the mobile terminal, receives a request for inputting new score data from the mobile terminal, and updates the stored score data based on the received request for inputting the new score data.

12 Claims, 4 Drawing Sheets

SCORE MANAGEMENT SYSTEM, SCORE MANAGEMENT SERVER, AND DATA RECORDING MEDIUM

TECHNICAL FIELD

The present invention relates to a score management system, a score management server, and a data recording medium, more particularly to a score management system, a score management server, and a data recording medium suitable for managing scores for games such as golf and orienteering in which players or player groups are playing the game while being distanced away from each other.

BACKGROUND ART

In a case where players or player groups (hereinafter, referred to simply as "players") are distanced away from each other and they can not talk to each other because of the distance during playing golf or orienteering, each player writes down his/her score on a card, and the cards are gathered after the game to result the final scores.

Such the conventional score management has the following problems.

The players may lose their competitive mind because no one knows the others' score during the game, and they may be bored after the game because it takes long time to result who is the winner and scoring order.

Since the players are distanced away from each other and game statuses of the players are unknown on real time, it is difficult to communicate with the other player. For example, even if one player is extremely distanced away from the former player although the players started the game at regular intervals, it is impossible to say his/her to accelerate his/her play.

The present invention has been made in consideration of the above problems, and it is an object of the present invention to provide a score management system, a score management server, and a data recording medium suitable for managing scores for games such as golf and orienteering in which players or player groups are playing the game while being distanced away from each other.

DISCLOSURE OF INVENTION

To accomplish the above object, this is to disclose the following present invention in accordance with the principle of the present invention.

The score management system according to a first aspect of the present invention is a system comprises mobile terminals (103), and a score management server (102) which are connected to each other via a wireless communication network (104).

The score management server (102) stores score data, receives a request for displaying score status from the mobile terminal (103), transmits data representing the score status based on the stored score data to the mobile terminal (103), receives a request for inputting new score data from the mobile terminal (103), and updates the stored score data in accordance with the received request for inputting the new score data.

The mobile terminal (103) transmits the request for displaying the score status to the score management server (102), receives the data representing the score status from the score management server (102), displays the score status in accordance with the received data representing the score status, and transmits the request for inputting new score data.

The mobile terminal (103) may be a mobile phone (including PHS (Personal Handyphone System)). In this case, the wireless communication network (104) may be a wireless internet service on a packet switching data communication network (for example, "DoPa" (TM) and "i-mode" (TM) provided by NTT DoCoMo Inc. which are major packet switching data communication service and wireless internet service in Japan).

A score management server according a second aspect of the present invention is a server being connected to mobile terminals (103) via a wireless communication network (104), comprises a storage unit (151), a display request receiver (152), a result transmitter (153), an input request receiver (154), and an update unit (155).

The storage unit (151) stores score data. The display request receiver (152) receives a request for displaying score status from the mobile terminal (103). The result transmitter (153) transmits data representing the score status based on the score data stored in the storage unit (151) to the mobile terminal (103) in response to the display request. The input request receiver (154) receives a request for inputting new score data from the mobile terminal (103). The update unit (155) updates the score data stored in the storage unit (151) based on the received request for inputting the new score data.

The score management server (102) may further comprise a transmission controller (156).

The transmission controller (156) controls the result transmitter (153) to transmit the data representing the score status to the mobile terminal (103) in response to the update of the score data.

In the score management server (102), the data representing the score status may include input area data representing input areas to be displayed on the mobile terminal (103) for inputting the new score data.

A computer readable data recording medium according to a third aspect of the present invention is a recording medium storing a program to be executed by a score management server (102) which is connected to mobile terminals (103) via a wireless communication network (104).

The program causes the score management server (102) to: store score data; receive a request for displaying score status from the mobile terminal (103); transmit data representing the score status based on the receive score data to the mobile terminal (103) in response to the display request; receive a request for inputting new score data from the mobile terminal (103); and update the stored score data in accordance with the received request for inputting the new score data.

The program may further cause the score management server (102) to transmit the data representing the score status to the mobile terminal (103) in response to the update of the score data.

The program may further cause the score management server (102) to add input area data representing input areas to be displayed on the mobile terminal (103) for new score data input, to the data representing the score status.

The program which realizes the score management system and the score management server according to the present invention may be stored in a data recording medium such as a compact disc, a floppy disk, a hard disk, a magneto-optical disk, a digital versatile disc, a magnetic tape, and a semiconductor memory module.

Executing the program stored in the data recording medium according to the present invention by a computer realizes the score management system and the score management server according to the present invention.

The data recording medium storing the program according to the present invention may be distributed and merchandised being independent from the system and the server.

The score management server according to the present invention may be a WWW (World Wide Web) server. In this case, the display request and the input request are replaced with web page request from the mobile terminal (103). The data representing the score status may be an HTML (Hyper Text Markup Language). In the HTML file, texts to be displayed are determined by HTML tags. The HTML tags determine not only highlights, underline, and the like, but also input areas where a user input data.

The HTML file representing the score status may include data (form data) for determining areas where the user of the mobile terminal (103) inputs various data. Score data input through thus prepared areas, the input score data are transferred to the WWW server as the input request.

The score management server (102) may execute a program such as CGI (Common Gateway Interface) script, Java applet, and HTML file including JavaScript codes, to perform score management processing.

BRIEF DESCRIPTION OF DRAWINGS

These objects and other objects and advantages of the present invention will become more apparent upon reading of the following detailed description and the accompanying drawings in which.

BEST MODE FOR CARRYING OUT THE INVENTION

An embodiment of the present invention will now be described. The following embodiment is just for explaining the present invention, therefore, it does not limit the scope of the present invention. Any embodiments modified by one skilled in the art based on some or all elements of the embodiment of the present invention will be included in the scope of the present invention.

Figure 1:
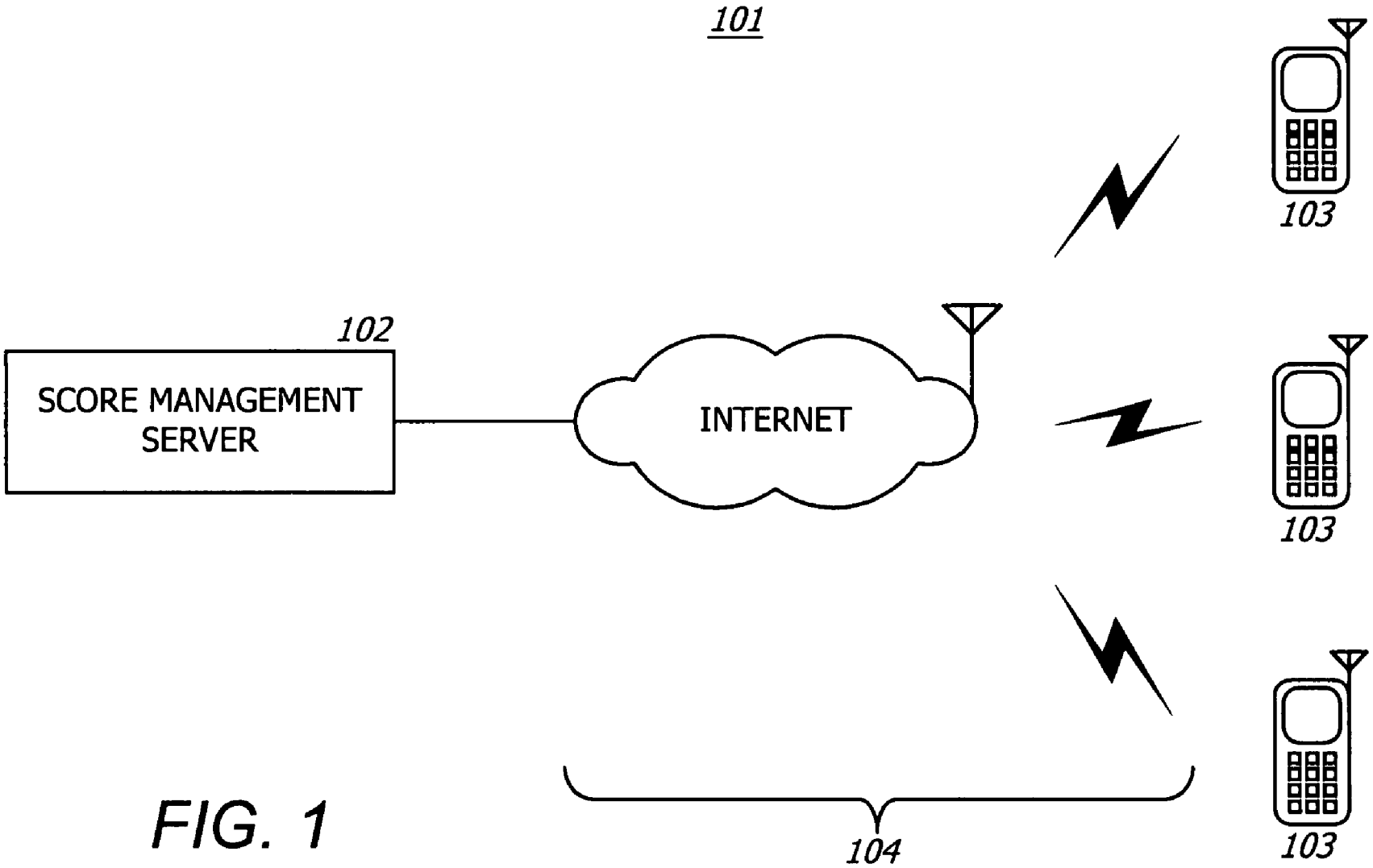
FIG. 1 is a diagram schematically showing the structure of the score management system according to an embodiment of the present invention.

FIG. 1 is a diagram schematically showing the structure of a score management system according to the embodiment of the present invention. For comprehensive explanation, the following description will employ golf score management as an example.

As shown in FIG. 1, a score management system 101 comprises a score management server 102, and a plurality of mobile terminals 103. A wireless communication network 104 interconnects the score management server 102 and the mobile terminals 103.

To reduce the costs by employing existing resources, the mobile terminals 103 may be, for example, mobile phones (especially employing "i-mode" (TM) system provided by NTT DoCoMo Inc., which is a major mobile phone internet service in Japan) which are connected by a wireless communication network featuring packet switching data communication (for example, "DoPa" (TM) provided by NTT DoCoMo Inc., which is a major wireless packet switching data communication service in Japan). In this case, the internet to which the score management server 102 is connected prepares interfaces for the wireless communication, thus, the wireless communication network 104 is realized.

A WWW server may act as the score management server 102. For comprehensive explanation, the following description will employ the WWW server as the score management server 102 as an example.

In a case where the WWW server is employed as the score management server 102, the location of the server is substantially unlimited. For example, it may be a club house in a golf course, or wherever if the internet is available.

Or, another high power WWW server which can manage scores of many players at many golf courses may be employed as the score management server 102 of the present invention. That is, an ordinary network-connectable computer is applicable to the score management server 102.

The mobile terminals 103 are held by the players respectively during the game, and they access the score management server 102. Thus, the players can share the score data among the them even if they are distanced away from each other.

Figure 2A:
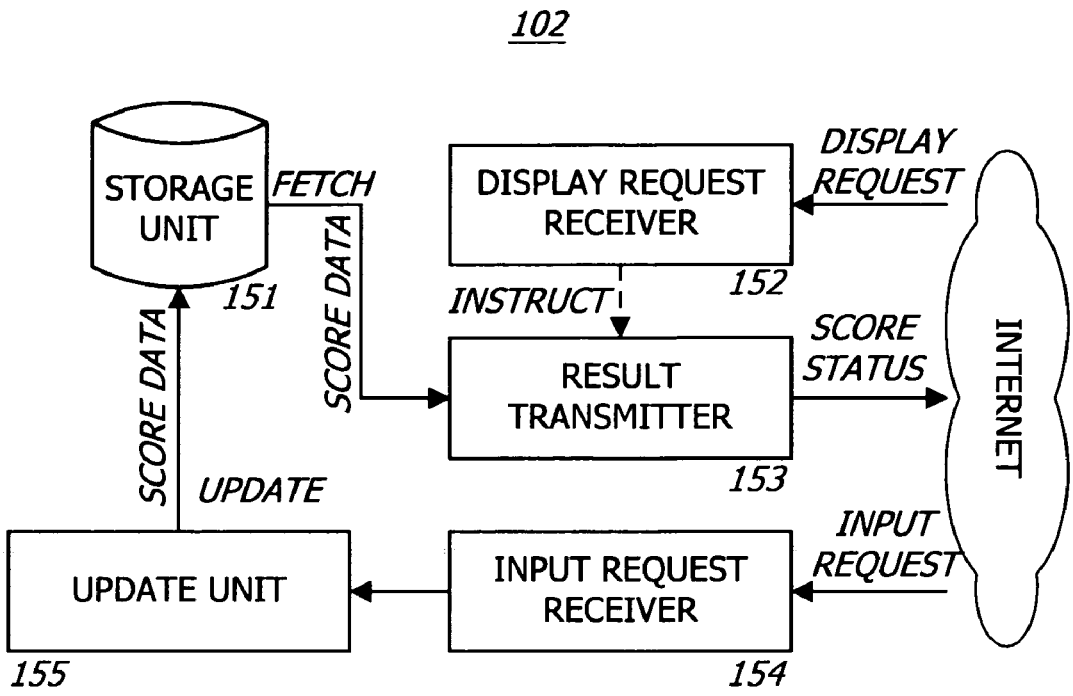
FIGS. 2A and 2B are block diagrams schematically showing the structure of the score management server according to the embodiment of the present invention.
Figure 2B:
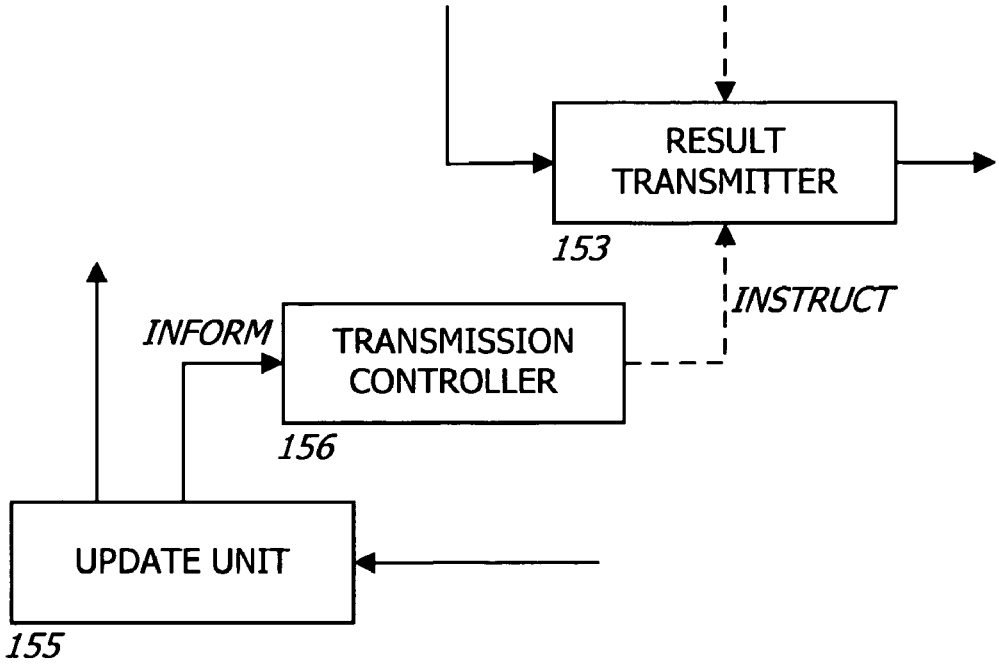

FIGS. 2A and 2B are block diagrams schematically showing the structure of the score management server according to the embodiment of the present invention. Like or same reference numerals as used in FIG. 1 are also used in FIGS. 2A and 2B to denote corresponding or identical components.

FIG. 2A shows the fundamental structure of the score management server according to the embodiment.

As shown in FIG. 2A, the score management server 102 comprises a storage unit 151, a display request receiver 152, a result transmitter 153, an input request receiver 154, and an update unit 155.

The storage unit 151 stores score data.

The display request receiver 152 receives display requests each requesting to display score status, from the mobile terminals 103 via the internet.

The result transmitter 153 transmits data representing the score status based on the score data in the storage unit 151 to the mobile terminal 103 concerned via the internet when the display request receiver 152 receives the display request.

The input request receiver 154 receives input requests each requesting to input the score data, from the mobile terminals 103 via the internet.

The update unit 155 updates the score data in the storage unit 151 based on the input request received by the input request receiver 154.

FIG. 2B shows an additional component applicable to the fundamental structure shown in FIG. 2A. As shown in FIG. 2B, a transmission controller 156 may intervene between the result transmitter 153 and the update unit 155. The transmission controller 156 receives an information that the score data in the storage unit 151 has been updated, from the update unit 155, and controls the result transmitter 153 to transmit the display data representing the score status to the mobile terminal 103 concerned via the internet.

Those components are realized by operating the WWW server, that is, a computer having a CPU, storage media such as a hard disk drive and RAM, a network interface board, and the like, as follows.

Figure 3:
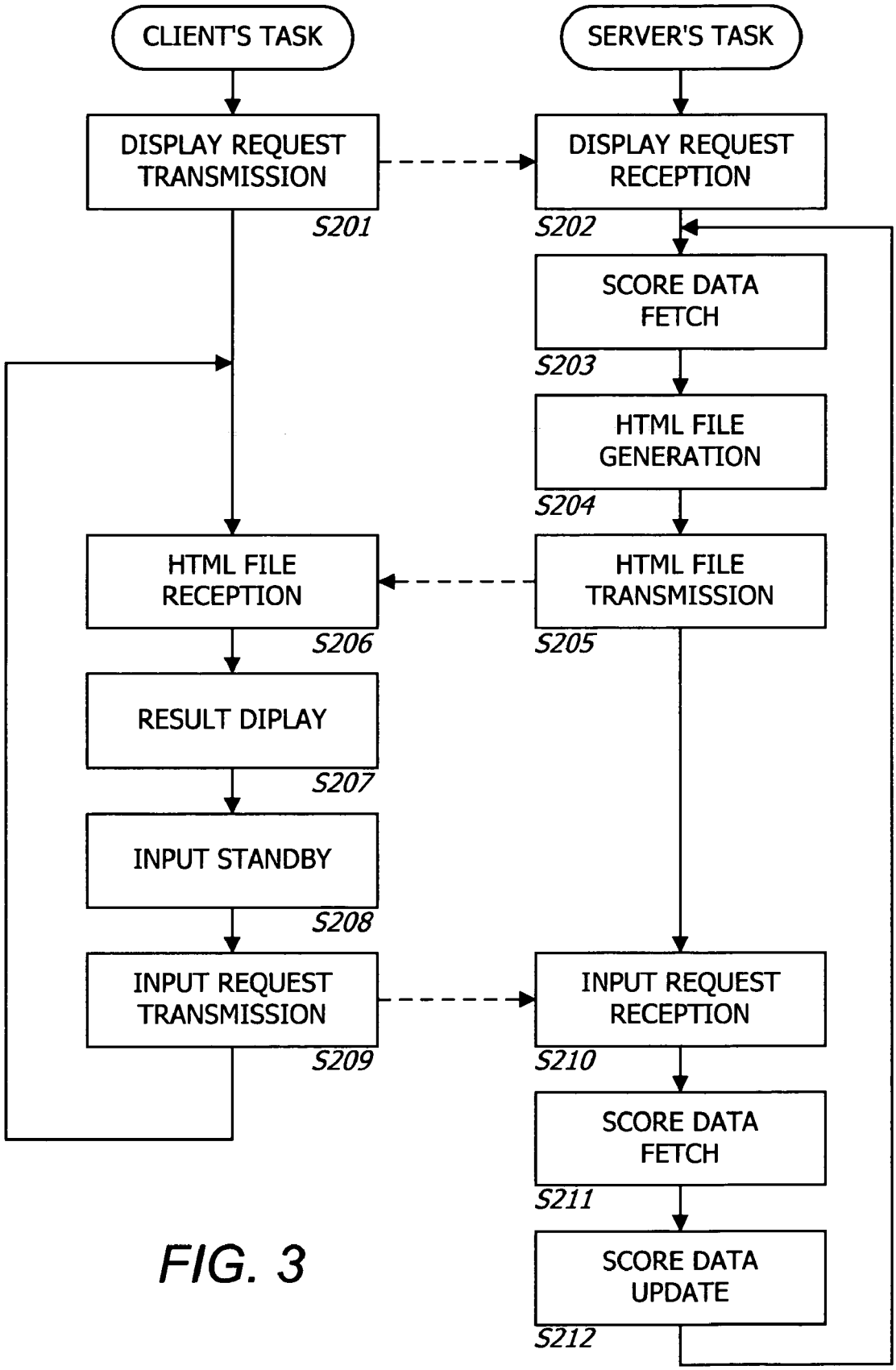
FIG. 3 is a flowchart showing steps of server processing executed by the server, and client processing executed by each client.

Server's tasks executed by the score management server 102 and client's tasks executed by any one of the mobile terminals 103 will now be described with reference to a flowchart shown in FIG. 3.

The client's data flow starts in response to the user's operation by which the mobile terminal 103 attempts to access the score management server 102 in order to request it to display or input score data.

More precisely, the flow starts when the user inputs URL (Uniform Resource Locator), http (Hyper Text Transfer Protocol) address, IP (Internet Protocol) address, and the like which identify the location of the score management server 102, through a WWW browser executed by the mobile terminal 103.

Once the clients flow starts, the mobile terminal 103 transmits a display request (for score status) to the score management server 102 based on the input http address (step S201).

Then, the score management server 102 receives the display request from the mobile terminal 103 (step S202).

At that time, the score management server 102 may perform verification to identify whether the mobile terminal 103 transmitting the display request is owned by the predetermined player. This process is helpful to avoid falsifying other's score, mistakenly inputting other's score, or the like.

The score management server 102 fetches score data sets of the players being stored in the storage medium such as the hard disk (step S203). Since the score management server 102 thus obtains the present score data, the players can also obtain the latest score data.

Then, the score management server 102 prepares an HTML file which includes the score data of the players (or score status information consisting required essential information from the score data), and an input form where the player inputs his/her score (step S204).

The required essential information may include, for example, names of top 10 players and their scores which are sorted or the like. Or, the essential information may represent the present rank of a specific player who transmitted the display request via the mobile terminal 103. In this case the score management server 102 determines the player concerned based on the display request received at step S202.

Once the players each owning the mobile terminal 103 are previously registered in the score management server 102, the player can access a storage medium such as a hard disk to refer to his/her own score data recorded hole by hole. If minimum hole No. of hole numbers whose relating scores are not stored yet does not coincide with number of the hole where the player plays, it reminds the player that he/she forgot to input the latest score, because the minimum hole No. concerned represents the present hole unless the player forgets to input the scores at every hole.

Then the score management server 102 sends the HTML file (representing the score status to be displayed) to the mobile terminal 103 concerned (step S205).

The mobile terminal 103 receives the HTML file from the score management server 102 (step S206), and displays the resultant texts in accordance with HTML tags (step S207).

Figure 4:
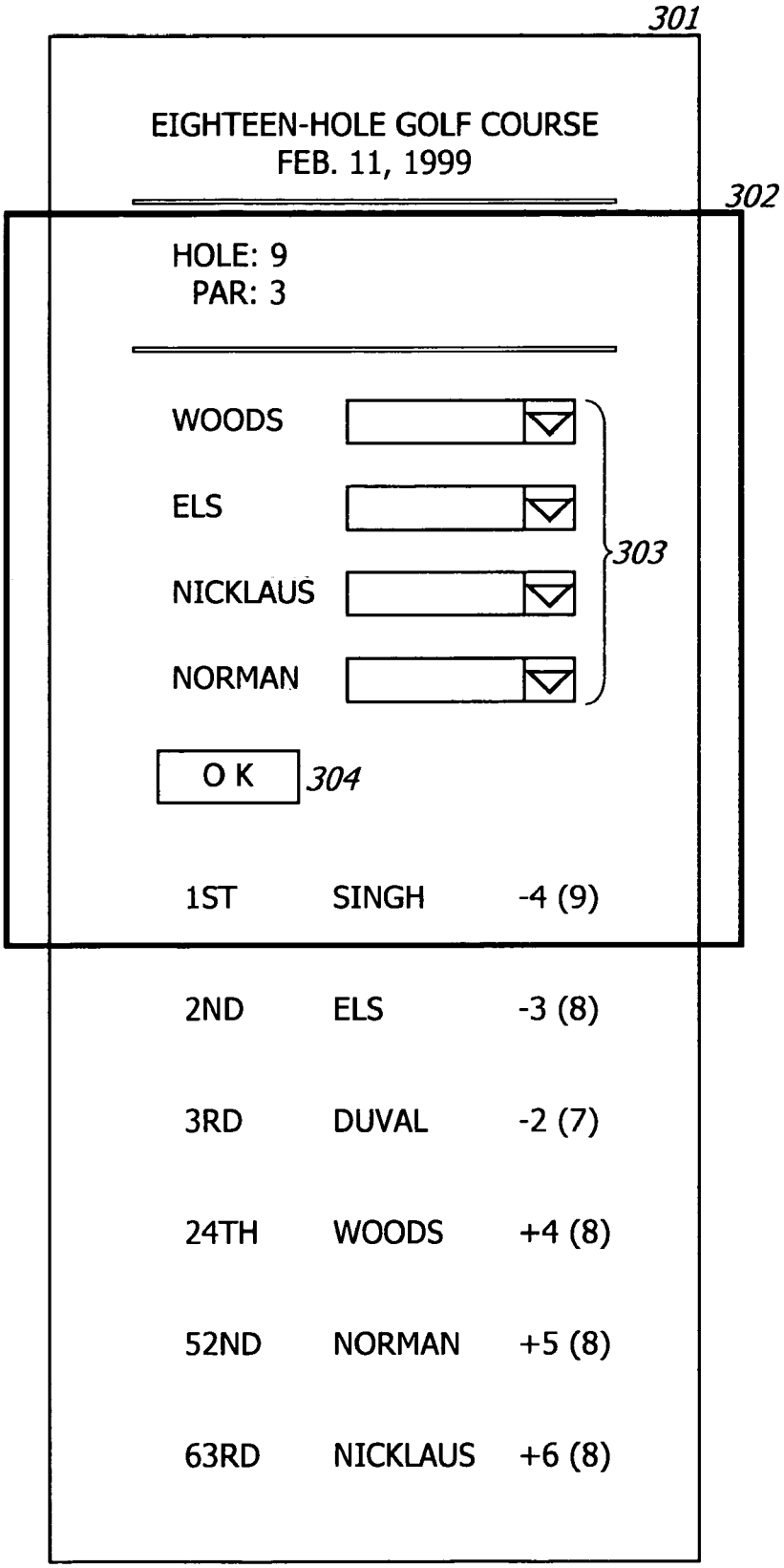
FIG. 4 is a diagram exemplifying a result display represented by an HTML file.

FIG. 4 exemplifies the texts displayed on a display screen of the mobile terminal 103. Since the display screen of the mobile terminal 103 is usually small, visible portion in the texts is limited. Therefore, the user may operate the mobile terminal 103 to scroll the texts to see desired portions.

FIG. 4 shows both the visible portions and hidden portions. In FIG. 4, a reference numeral 301 denotes hole contents of the texts, and a reference numeral 302 denotes a frame which determines the visible area. As the user operates the mobile terminal 103 for scroll, the frame 302 moves, and the contents within the frame 302 are visible.

FIG. 4 exemplifies the following information.

Name of the Golf Course: Eighteen-Hole Golf Course

Date: Aug. 11, 1999

Minimum Hole No. to be Recorded (regarding to a party owning the mobile terminal 103): Hole No. 9

Par (Hole No. 9): Par 3

Players of the Party: "Woods", "Els", "Nicklaus", and "Norman"

Input Areas (303) Player by Player

Gathered All Player's Scores: scores and ranking of top 3 players and players who have the mobile terminals 103 are shown. In FIG. 4, for example, "1st" place player is "Singh" scoring "4 under" after "9th hole", "52nd" place player is "Norman" who has finished "8th hole" and scores "5 over".

The mobile terminal 103 stands by score input via the input areas 303 (step S208).

In ordinary golf play, a party (player group) includes 4 players, therefore, input areas 303 are prepared for 4 players. The player operates a scroll button and ten-keys of the mobile terminal 103 to input his/her score in the input area 303. After the score input, the player operates the scroll button or the like of the mobile terminal 103 to select an OK button 304 in the displayed field.

The mobile terminal 103 regards the selection of the OK button 304 as score input completion, and sends a data input request to the score management server 102 for registering the input score data to the score management server 102 (step S209).

The score management server 102 receives the data input request from the mobile terminal 103 (step S210).

The score management server 102 fetches the score data (representing scores player by player) from the received data input request (step S211), and updates the score data being stored in the storage medium such as the hard disk in accordance with the fetched score data (step S212).

For example, if one player's scores after 8th hole have been stored in the storage medium (hard disk, etc.), the score data of the player concerned obtained at step S211 are added to the storage medium as the score data of the 9th hole.

In the score management server 102, the process flow returns to step S203 after the score update.

In the mobile terminal 103, the process flow returns to step S206 after the process at step S209 is completed.

Accordingly, the latest score data based on the input score data are displayed on the display screen of the mobile terminal 103.

Additional steps may be employed. For example, the mobile terminal 103 may check the input score to warn the player if the input score was wrong. In this case, the mobile terminal 103 may request the player to input correct score.

The score management server 102 may also check the input score at the reception of the data input request.

Accordingly, each player inputs score data through the mobile terminal 103 and the score management server 102 gathers and manages the score data. Each player can see all players' scores on real time, therefore, the players enjoy the game with by knowing the scores altering each hole. Moreover, final results are shown immediately after the game finishes.

One skilled in the art may easily add other functions to the above embodiment, for example, handling handicap information, much play rule, penalties when putting over 3 times or lost in water hazard. The scope of the invention will include any modifications like the above. According to the embodiment of the present invention, the invention may employ various calculation methods for scoring or ranking which are different by courses or games to flexibly output results.

As described above, the present invention provides a score management system, a score management server, and a data recording medium, more particularly a score management system, a score management server, and a data recording medium suitable for managing scores for a game in which players or player groups are distanced away from each other.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. H11-166354 filed on Jun. 14, 1999 and including specification, claims, drawings and summary. The disclosure of the above Japanese Patent Application is incorporated herein by reference in its entirety.

What is claimed is:

1. A score management system which comprises mobile terminals and a score management server being connected to each other via a wireless communication network, wherein, (a) said score management server:

stores score data;

receives a request for displaying score status from a mobile terminal and performs a verification to identify said mobile terminal;

transmits data representing the score status based on the stored score data of a player associated with said verification and high-ranking players and an input form to be displayed on said mobile terminal for the players associated with said verification, to said mobile terminal;

receives a request for inputting new score data from said mobile terminal;

updates the stored score data based on the received request for inputting the new score data;

checks said new score data received;

transmits the input form to said mobile terminal in the case that said new score data is wrong in order to input a correct score; and updating said new score data in the case that said new score data is not wrong, and (b) said mobile terminal:

transmits the request for displaying the score status to said score management server;

displays the score status based on the received data representing the score status; and transmits the request for inputting the score data in response to the player's input, to said score management server.

2. A score management server being connected to mobile terminals via wireless communication network, said server comprising:

a storage unit which stores score data;

a display request receiver which receives a request for displaying score status from said a mobile terminal and performs a verification to identify said mobile terminal;

a result transmitter which transmits data representing the score status based on the score data stored in said storage unit of a player associated with said verification and the high-ranking players, to said mobile terminal in response to the display request;

a form transmitter which transmits an input form to be displayed on said mobile terminal for the player associated with said verification, to said mobile terminal;

an input request receiver which receives a request for inputting new score data from said mobile terminal;

an update unit which updates the score data stored in said storage unit based on the received request for inputting the new score data; and a score checker that checks said new score data received by said input request receiver; and wherein, said form transmitter transmits the input form to said mobile terminal in the case that said new score data is wrong in order to input a correct score, and said update unit updates said new score data in the case that said new score data is not wrong.

3. The score management server according to claim 2 further comprising a transmission controller which controls said result transmitter to transmit the data representing the score status in response to the update of the score data.

4. The score management server according to claim 2, wherein said transmitter and said form transmitter embed the data representing the score status and the input form in order to transmit them to said mobile terminal so that the player can input the new score data.

5. The score management server according to claim 2, wherein said mobile terminal is a portable phone or a cellular phone and a telephone number is used to identify said mobile terminal.

6. A computer readable data recording medium storing a program to be executed by a score management server being connected to mobile terminals via a wireless communication network, said program causes said score management server to:

store score data;

receive a request for displaying score status and perform a verification to identify said mobile terminal from said mobile terminals;

transmit data representing the score status based on the stored score data of a player associated with said verification and high-ranking players, to said mobile terminal in response to the display request;

transmit an input form to be displayed on said mobile terminal for the player associated with an identifier;

receive a request for inputting new score data from said mobile terminal;

update the stored score data based on the received request for inputting the new score data;

check said new score data received;

transmit the input form to said mobile terminal in the case that said new score data is wrong in order to input the correct score, and update said new score data in the case that said new score data is not wrong.

7. The data recording medium according to claim 6, wherein said program further causes said score management server to transmit the data representing the score status to said mobile terminal in response to the update of the score data.

8. The data recording medium according to claim 7, wherein said data recording medium is one of a compact disc, a floppy disk, a hard disk, a magneto-optical disk, a digital versatile disc, a magnetic tape, or a semiconductor memory module.

9. The data recording medium according to claim 6, wherein said program further causes said score management server to embed the data representing the score status and the input form in order to transmit them to said mobile terminal.

10. The data recording medium according to claim 9, wherein said data recording medium is one of compact disc, a floppy disk, a hard disk, a magneto-optical disk, a digital versatile disc, a magnetic tape, or a semiconductor memory module.

11. The data recording medium according to claim 6, wherein said data recording medium is one of a compact disc, a floppy disk, a hard disk, a magneto-optical disk, a digital versatile disc, a magnetic tape, or a semiconductor memory module.

12. A score management server being connected to mobile terminals via wireless communication network, said server comprising:

a storage unit which stores score data;

a display request receiver which receives a request for displaying score status from said mobile terminal and an identifier of a mobile terminal;

a result transmitter which transmits data representing the score status based on the score data stored in said storage unit of a player associated with said identifier of said mobile terminal and high-ranking players, to said mobile terminal in response to the display request;

a form transmitter which transmits an input form to be displayed on said mobile terminal for the players associated with said identifier, to said mobile terminal;

an input request receiver which receives a request for inputting new score data from said mobile terminal;

an update unit which updates the score data stored in said storage unit based on the received request for inputting the new score data;

a score checker that checks said new score data received by said input request receiver; and wherein, said form transmitter transmits the input form to said mobile terminal in the case that said new score data is wrong in order to input the correct score, and said update unit updates said new score data in the case that said new score data is not wrong.

* * * * *